US006406157B1

(12) United States Patent
Audet

(10) Patent No.: US 6,406,157 B1
(45) Date of Patent: Jun. 18, 2002

(54) EYEBROW GROOMING TOOL

(76) Inventor: Diane L. Audet, 3101 Eastwood, Rochester Hills, MI (US) 48309

( * ) Notice: Subject to any disclaimer, the term of this patent is extended or adjusted under 35 U.S.C. 154(b) by 0 days.

(21) Appl. No.: 09/453,192

(22) Filed: Dec. 2, 1999

(51) Int. Cl.[7] ..... B26B 19/46

(52) U.S. Cl. ..... 362/11.5; 30/34.05; 30/64; 30/535; 30/537; 132/289

(58) Field of Search ..... 30/34.05, 50, 51, 30/62, 64, 32, 535, 537; 132/288, 289, 290; 362/115

(56) References Cited

U.S. PATENT DOCUMENTS

| | | | | | |
|---|---|---|---|---|---|
| 937,992 | A | * | 10/1909 | Gilda | 30/34.05 X |
| 1,180,696 | A | * | 4/1916 | Allport | 362/115 |
| 1,392,753 | A | * | 10/1921 | Franck | 132/290 |
| 1,440,325 | A | * | 12/1922 | Wilhelm | 362/115 |
| 1,453,014 | A | * | 4/1923 | Kohn | 30/34.05 X |
| 1,892,836 | A | * | 1/1933 | Harvey | 30/535 X |
| 1,950,789 | A | * | 3/1934 | Eells | 30/34.05 X |
| 2,309,035 | A | * | 1/1943 | Beam | 30/34.05 X |
| 2,460,522 | A | * | 2/1949 | Miller | 30/34.05 X |
| 2,546,928 | A | * | 3/1951 | Masabny | 30/34.05 X |
| 2,547,376 | A | * | 4/1951 | Crawford | 30/34.05 |
| 2,592,488 | A | * | 4/1952 | Testi | 30/64 |
| 3,562,905 | A | | 2/1971 | Rakocy et al. | 30/34.05 |
| 3,646,674 | A | * | 3/1972 | Fitzpatrick | 30/64 |
| 4,094,062 | A | | 6/1978 | Papanikolaou | 30/34.05 |
| 4,285,124 | A | | 8/1981 | Diakonov | 30/34.1 |
| 4,473,943 | A | | 10/1984 | Papanikolaou | 30/34.05 |
| 5,095,621 | A | | 3/1992 | Rapp | 30/539 |
| 5,299,104 | A | | 3/1994 | Parmentier | 362/115 |
| 5,582,476 | A | * | 12/1996 | Hansen | 362/115 |

* cited by examiner

*Primary Examiner*—Clark F. Dexter
(74) *Attorney, Agent, or Firm*—Joseph N. Breaux

(57) ABSTRACT

An eyebrow grooming tool that includes a molded plastic handle and a razor blade cartridge holding assembly in connection with the plastic handle. The razor blade cartridge holding assembly is provided with a light source shining through two elongated transparent windows positioned on either side of the razor blade cartridge for illuminating the eyebrow to be trimmed. A brush for grooming the eyebrow before and after trimming by the razor assembly is provided at the back end of the handle.

1 Claim, 2 Drawing Sheets

FIG.3
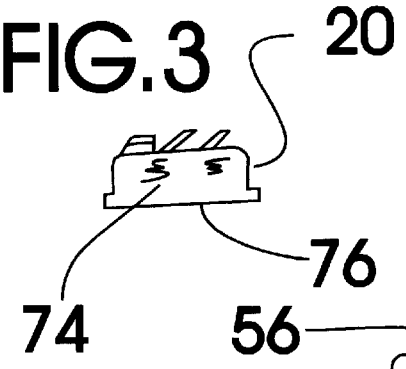
FIG.4
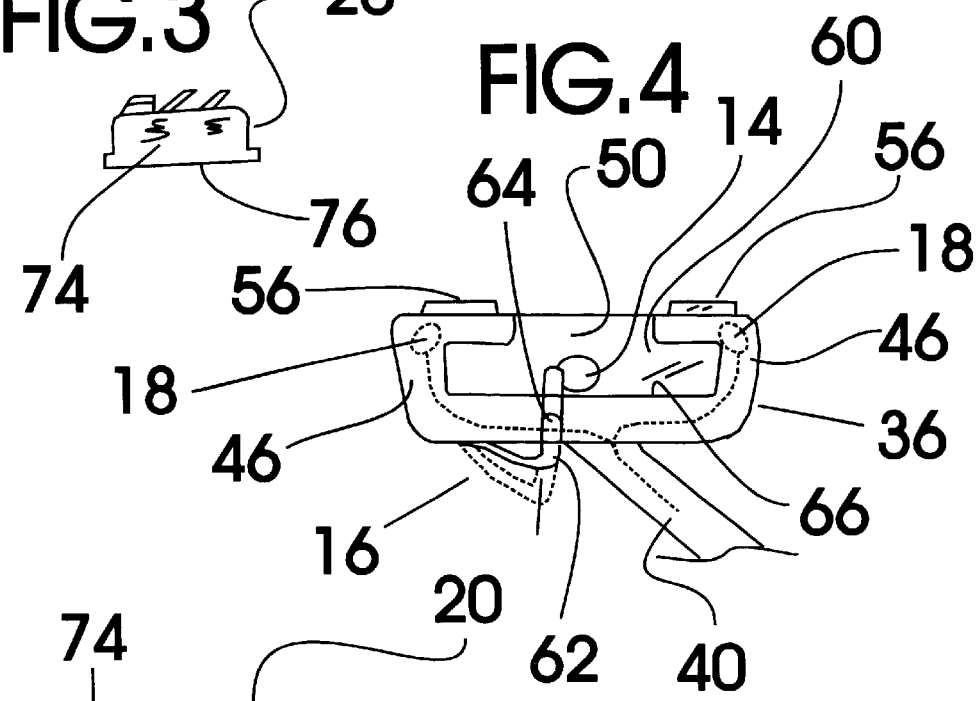
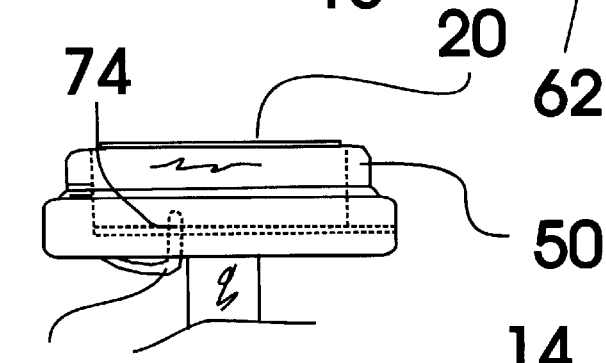
FIG.5
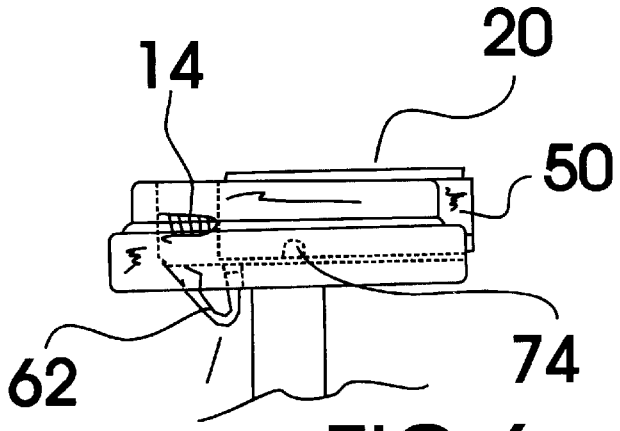
FIG.6

EYEBROW GROOMING TOOL

TECHNICAL FIELD

The present invention relates to grooming tools and more particularly to an eyebrow grooming tool that includes a molded plastic handle including a gripping portion, a battery compartment door in the back side thereof in connection with a battery compartment formed therein and housing a battery connector therein, two eyebrow pencil storage tubes formed into the bottom end thereof, a brush portion extending from the bottom end portion thereof, a razor blade cartridge holding assembly attached to a front end of the handle with a tubular support arm, the razor blade cartridge holding assembly including two light source cavities formed on either side of a T-shaped cross sectional blade cartridge insertion slot open on one side of the razor blade cartridge holding assembly and each covered by an elongated transparent window; a blade cartridge ejection spring secured to an interior side wall defining the blade cartridge insertion slot opposite the open side thereof; a blade cartridge retaining mechanism including a flexible resilient retaining pin positioned through a pin passage hole formed through a bottom surface defining the blade cartridge insertion slot and deflectable between a position extending past the bottom surface and into a pin receiving cavity formed within a bottom of each razor blade cartridge and a positioned below the bottom surface; a light source positioned within each of the light source cavities and connected to the battery connector and a two-position on/off switch by wires running through the tubular support arm; and a razor blade cartridge sized and shaped to slide into the T-shaped cross sectional blade cartridge insertion slot and having a pin receiving cavity formed within the bottom cartridge surface positioned such that when the razor blade cartridge is fully inserted into the T-shaped cross sectional blade cartridge insertion slot the pin receiving cavity is aligned with the pin passage hole formed through the bottom surface defining the blade cartridge insertion slot.

BACKGROUND ART

Trimming eye brows can be difficult because the trimmer's hand often obscures the light onto the eyebrow to be trimmed. It would be a benefit, therefore, to have an eye brow trimming tool that included a light source adjacent to a trimming blade to direct light onto the eyebrow being trimmed. In addition, because it is important that the eye brow hairs of the eyebrow be brushed into their natural positions before trimming, it would be a further benefit to have an eyebrow grooming tool that included an eyebrow trimming mechanism in combination with an eyebrow brushing mechanism.

GENERAL SUMMARY DISCUSSION OF INVENTION

It is thus an object of the invention to provide an eyebrow grooming tool that includes a molded plastic handle including a gripping portion, a battery compartment door in the back side thereof in connection with a battery compartment formed therein and housing a battery connector therein, two eyebrow pencil storage tubes formed into the bottom end thereof, a brush portion extending from the bottom end portion thereof, a razor blade cartridge holding assembly attached to a front end of the handle with a tubular support arm, the razor blade cartridge holding assembly including two light source cavities formed on either side of a T-shaped cross sectional blade cartridge insertion slot open on one side of the razor blade cartridge holding assembly and each covered by an elongated transparent window; a blade cartridge ejection spring secured to an interior side wall defining the blade cartridge insertion slot opposite the open side thereof; a blade cartridge retaining mechanism including a flexible resilient retaining pin positioned through a pin passage hole formed through a bottom surface defining the blade cartridge insertion slot and deflectable between a position extending past the bottom surface and into a pin receiving cavity formed within a bottom of each razor blade cartridge and a positioned below the bottom surface; a light source positioned within each of the light source cavities and connected to the battery connector and a two-position on/off switch by wires running through the tubular support arm; and a razor blade cartridge sized and shaped to slide into the T-shaped cross sectional blade cartridge insertion slot and having a pin receiving cavity formed within the bottom cartridge surface positioned such that when the razor blade cartridge is fully inserted into the T-shaped cross sectional blade cartridge insertion slot the pin receiving cavity is aligned with the pin passage hole formed through the bottom surface defining the blade cartridge insertion slot.

Accordingly, an eyebrow grooming tool is provided. The eyebrow grooming tool includes a molded plastic handle including a gripping portion, a battery compartment door in the back side thereof in connection with a battery compartment formed therein and housing a battery connector therein, two eyebrow pencil storage tubes formed into the bottom end thereof, a brush portion extending from the bottom end portion thereof, a razor blade cartridge holding assembly attached to a front end of the handle with a tubular support arm, the razor blade cartridge holding assembly including two light source cavities formed on either side of a T-shaped cross sectional blade cartridge insertion slot open on one side of the razor blade cartridge holding assembly and each covered by an elongated transparent window; a blade cartridge ejection spring secured to an interior side wall defining the blade cartridge insertion slot opposite the open side thereof; a blade cartridge retaining mechanism including a flexible resilient retaining pin positioned through a pin passage hole formed through a bottom surface defining the blade cartridge insertion slot and deflectable between a position extending past the bottom surface and into a pin receiving cavity formed within a bottom of each razor blade cartridge and a positioned below the bottom surface; a light source positioned within each of the light source cavities and connected to the battery connector and a two-position on/off switch by wires running through the tubular support arm; and a razor blade cartridge sized and shaped to slide into the T-shaped cross sectional blade cartridge insertion slot and having a pin receiving cavity formed within the bottom cartridge surface positioned such that when the razor blade cartridge is fully inserted into the T-shaped cross sectional blade cartridge insertion slot the pin receiving cavity is aligned with the pin passage hole formed through the bottom surface defining the blade cartridge insertion slot.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 3 is side plan view of the razor blade cartridge in isolation showing the retaining ledges, the two angled razor blades, and the pin receiving cavity formed within the bottom cartridge surface.

FIG. 4 is a side plan view of the razor blade cartridge holding assembly in isolation with the razor blade cartridge removed to show the two light sources positioned within the light source cavities beneath the two elongated transparent windows, the T-shaped cross sectional blade cartridge insertion slot, the blade cartridge ejection spring secured to the interior side wall defining the blade cartridge insertion slot opposite the open side thereof, and the blade cartridge retaining mechanism including the flexible resilient retaining pin positioned through the pin passage hole formed through the bottom surface defining the blade cartridge insertion slot.

FIG. 5 is a partial side plan view of the razor blade cartridge holding assembly with the razor blade cartridge fully inserted.

FIG. 6 is a second partial side plan view of the razor blade cartridge holding assembly.

EXEMPLARY MODE FOR CARRYING OUT THE INVENTION

Figure 1:
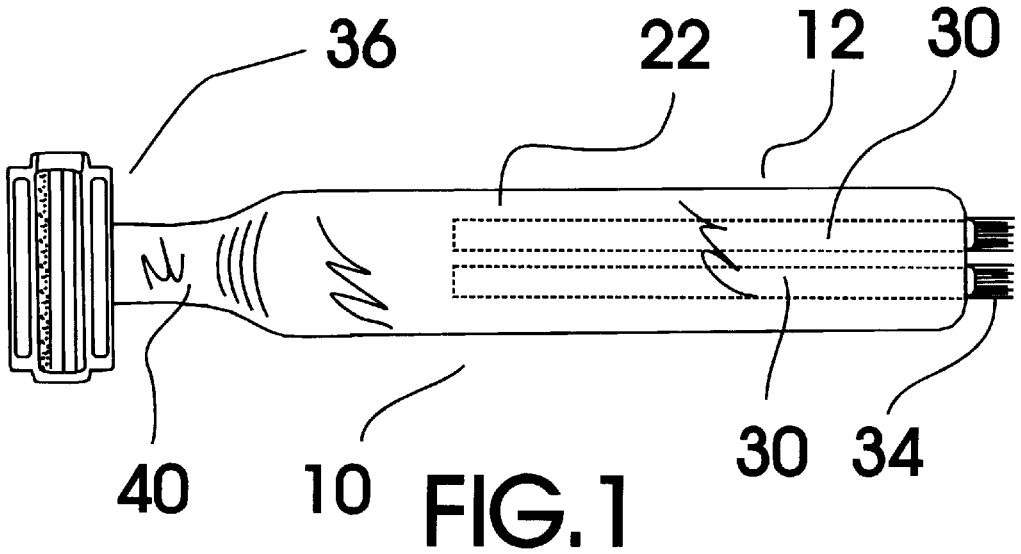
FIG. 1 is a top plan view of an exemplary embodiment of the eyebrow grooming tool of the present invention.

FIG. 1 shows an exemplary embodiment of the eyebrow grooming tool of the present invention generally designated 10. Eyebrow grooming tool 10 includes a molded plastic handle, generally designated 12; a blade cartridge ejection spring 14 (FIG. 4); a blade cartridge retaining mechanism, generally designated 16 (FIG. 4); two diode light sources 18 (FIG. 4); and a razor blade cartridge, generally designated 20 (FIG. 3).

Figure 2:
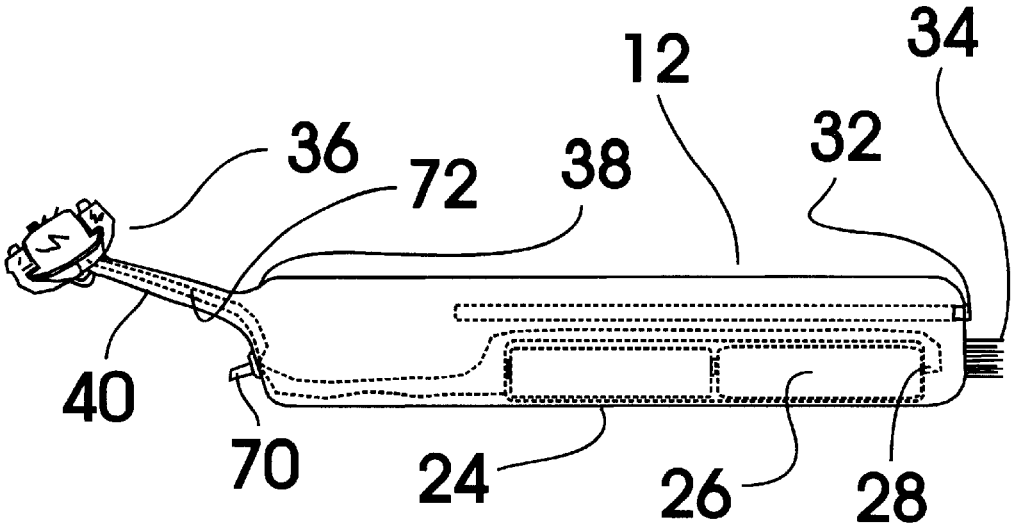
FIG. 2 is a side plan view of the eyebrow grooming tool of FIG. 1.

Molded plastic handle 12 includes a gripping portion 22, referring to FIG. 2), a battery compartment door 24 in the back side thereof in connection with a battery compartment 26 formed therein and housing a battery connector 28 therein, two eyebrow pencil storage tubes 30 (both shown in FIG. 1) formed into the bottom end 32 thereof, a brush portion 34 extending from bottom end 32 thereof, a razor blade cartridge holding assembly, generally designated 36 attached to a front end 38 of handle 12 with a tubular support arm 40.

Referring to FIG. 4, razor blade cartridge holding assembly 36 includes two light source cavities 46 formed on either side of a T-shaped cross sectional blade cartridge insertion slot 50 open on one side of the razor blade cartridge holding assembly that are each covered by an elongated transparent window 56. Bade cartridge ejection spring 14 is secured to an interior side wall 60 defining the blade cartridge insertion slot 50 that is opposite the open side thereof. Blade cartridge retaining mechanism 16 includes a flexible resilient retaining pin 62 positioned through a pin passage hole 64 (shown in dashed lines) formed through a bottom surface 66 defining blade cartridge insertion slot 50 that is deflectable between a position extending past bottom surface 66 and positioned below bottom surface 66 (see FIG. 6).

The diode light source 18 is positioned within each of the light source cavities 46 and are connected to the battery connector 28 and a two-position on/off switch 70 (FIG. 2) by wires 72 running through tubular support arm 40.

Referring to FIG. 3, razor blade cartridge 20 is sized and shaped to slide into T-shaped cross sectional blade cartridge insertion slot 50 (FIG. 4) and has a pin receiving cavity 74 formed through the bottom cartridge surface 76 such that when, referring to FIG. 5, razor blade cartridge 20 is fully inserted into the T-shaped cross sectional blade cartridge insertion slot 50 pin receiving cavity 74 is aligned with pin passage hole 64 (FIG. 4) formed through bottom surface 66 defining the blade cartridge insertion slot 50 allowing flexible resilient retaining pin 62 to engage pin receiving cavity 74 and hold razor blade cartridge in place for use. Referring to FIG. 6, when it is desired to remove razor blade cartridge 20 for replacement, flexible resilient retaining pin 62 is pulled outward from pin receiving cavity 74 allowing ejection spring 14 to force razor blade cartridge 20 outward through the open side of T-shaped cross sectional blade cartridge insertion slot 50.

It can be seen from the preceding description that an eyebrow grooming tool has been provided that includes a molded plastic handle including a gripping portion, a battery compartment door in the back side thereof in connection with a battery compartment formed therein and housing a battery connector therein, two eyebrow pencil storage tubes formed into the bottom end thereof, a brush portion extending from the bottom end portion thereof, a razor blade cartridge holding assembly attached to a front end of the handle with a tubular support arm, the razor blade cartridge holding assembly including two light source cavities formed on either side of a T-shaped cross sectional blade cartridge insertion slot open on one side of the razor blade cartridge holding assembly and each covered by an elongated transparent window; a blade cartridge ejection spring secured to an interior side wall defining the blade cartridge insertion slot opposite the open side thereof; a blade cartridge retaining mechanism including a flexible resilient retaining pin positioned through a pin passage hole formed through a bottom surface defining the blade cartridge insertion slot and deflectable between a position extending past the bottom surface and into a pin receiving cavity formed within a bottom of each razor blade cartridge and a positioned below the bottom surface; a light source positioned within each of the light source cavities and connected to the battery connector and a two-position on/off switch by wires running through the tubular support arm; and a razor blade cartridge sized and shaped to slide into the T-shaped cross sectional blade cartridge insertion slot and having a pin receiving cavity formed within the bottom cartridge surface positioned such that when the razor blade cartridge is fully inserted into the T-shaped cross sectional blade cartridge insertion slot the pin receiving cavity is aligned with the pin passage hole formed through the bottom surface defining the blade cartridge insertion slot.

It is noted that the embodiment of the eyebrow grooming tool described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An eyebrow grooming tool comprising:

a molded plastic handle including a gripping portion and further including a battery compartment, a battery connector within the battery compartment, a battery compartment door removably covering the battery compartment, two eyebrow pencil storage tubes formed into a bottom end of the handle, a brush portion extending from said bottom end of the handle, a razor blade cartridge holding assembly attached to a front end of said handle by a tubular support arm, said razor blade cartridge holding assembly including two light source cavities formed on either side of a T-shaped cross sectional cartridge insertion slot open on one side of said razor cartridge holding assembly and each covered by an elongate transparent window;

a blade cartridge ejection spring secured to an interior side wall defining said blade cartridge insertion slot opposite said open side thereof;

a blade cartridge retaining mechanism including a flexible resilient retaining pin positioned through a pin passage hole formed in the razor blade cartridge holding assembly and deflectable into and out of said blade cartridge insertion slot;

a light source positioned within each of said light source cavities and connected to said battery connector and a two-position on/off switch by wires running through said tubular support arm; and a razor blade cartridge slidably received in said T-shaped cross sectional blade cartridge insertion slot and having a pin receiving cavity in which said flexible resilient retaining pin is removably received such that when said razor blade cartridge is fully inserted into said T-shaped cross sectional blade cartridge insertion slot said pin receiving cavity is aligned with said pin passage hole in a manner to receive an end of said flexible resilient retaining pin positioned through the pin passage hole.

* * * * *